United States Patent [19]

Birkett

[11] Patent Number: 4,760,790

[45] Date of Patent: Aug. 2, 1988

[54] PRINTING PRESSES

[75] Inventor: John N. Birkett, Aylesbury, United Kingdom

[73] Assignee: Reed Packaging Limited, England

[21] Appl. No.: 836,647

[22] Filed: Mar. 5, 1986

[30] Foreign Application Priority Data

Mar. 5, 1985 [GB] United Kingdom ..... 8505557

[51] Int. Cl.[4] ..... B41M 5/00

[52] U.S. Cl. ..... 101/470; 101/DIG. 13; 250/319

[58] Field of Search ..... 101/467, 470, DIG. 13; 250/316.1, 317, 318, 319, 317.1

[56] References Cited

U.S. PATENT DOCUMENTS

| | | | |
|---|---|---|---|
| 3,829,982 | 8/1974 | Pray et al. . | |
| 3,902,062 | 8/1975 | Eiclorn | 101/470 X |
| 3,904,825 | 9/1975 | Rees et al. | 101/470 X |
| 3,909,613 | 9/1975 | Critchlow | 250/319 |
| 3,999,852 | 12/1976 | Katayama et al. | 101/470 X |
| 4,001,541 | 1/1977 | Hatch et al. | 250/317.1 X |
| 4,001,622 | 1/1977 | Howell | 250/317.1 X |
| 4,008,962 | 2/1977 | Nepper | 250/317.1 X |
| 4,025,182 | 5/1977 | Goel | 101/470 X |
| 4,034,186 | 7/1977 | Bestenseiner et al. | 250/319 X |
| 4,060,382 | 11/1977 | Vertegaal | 101/470 X |
| 4,177,383 | 12/1979 | Knight . | |
| 4,323,775 | 4/1982 | Hagegawa et al. | 250/319 X |

FOREIGN PATENT DOCUMENTS

| | | |
|---|---|---|
| 2086751 | 12/1971 | France . |
| WO81/00683 | 3/1981 | PCT Int'l Appl. . |
| 386840 | 1/1933 | United Kingdom . |

*Primary Examiner*—Paul T. Sewell
*Assistant Examiner*—James P. McDaniel
*Attorney, Agent, or Firm*—Bacon & Thomas

[57] ABSTRACT

There is provided a web printing apparatus (20 ) comprising a web feed means (4, 5, 6), two or more printing stations (21, 22) arranged to print radiation-curable ink onto a web (3) and a primary radiation source (11) arranged to radiate said web with an ink-curing radiation after said web has passed a first said printing station (21) and before said web passes the subsequent printing station (22), wherein said apparatus further comprises a plurality of secondary radiation sources (13, 14) each extending part way across the width of said web and each being arranged to radiate a part of said width after said web has passed said first printing station and before it has passed said subsequent printing station. By controlling the positioning of the secondary radiation sources, generally UV sources, and the radiation emission levels of the primary (11) and secondary (13, 14) radiation sources, wastage may be reduced and efficient ink curing can be achieved with lower power consumption and with lower press operating tempertures than is possible with the use of only the primary radiation sources.

14 Claims, 1 Drawing Sheet

PRINTING PRESSES

Figure 1:
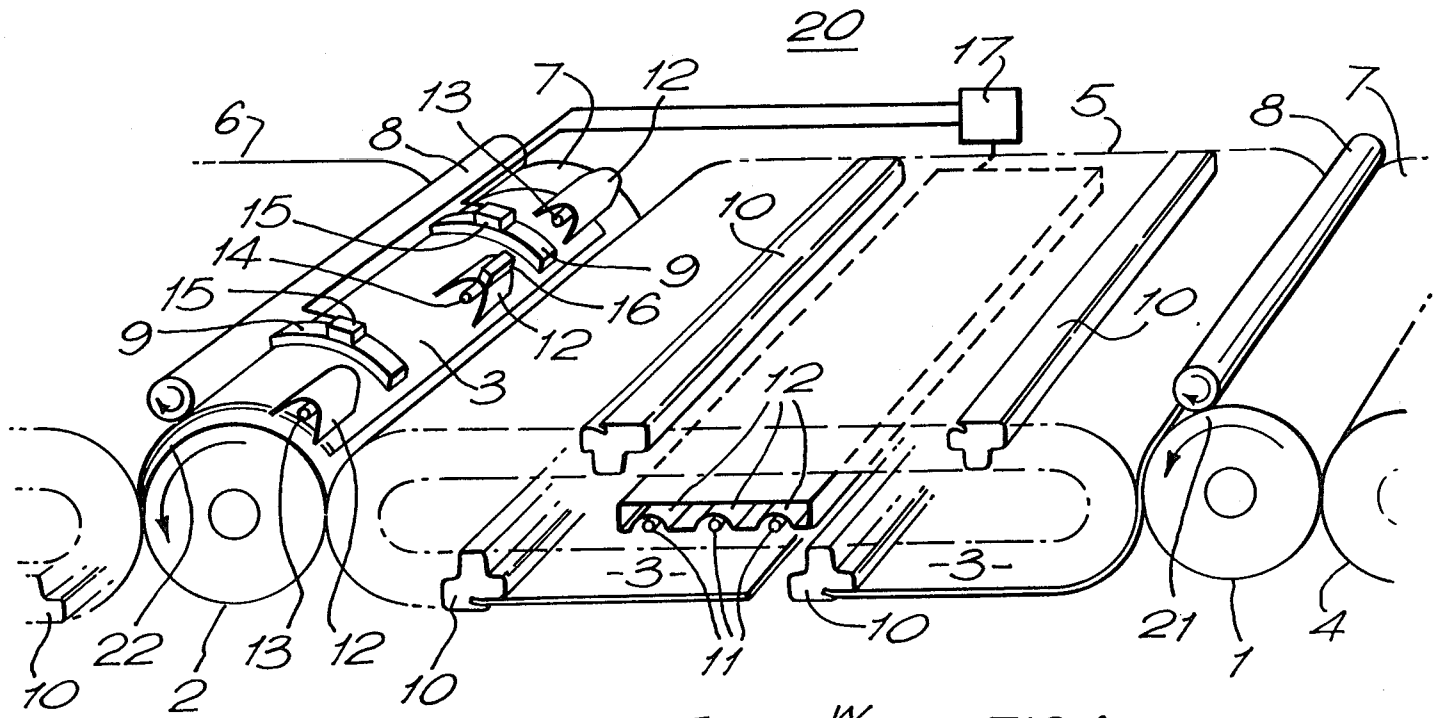

The present invention relates to certain improvements in and relating to printing pressues and in particular to an improved printing apparatus for printing radiation-curable inks onto webs.

The term "web" is used herein to denote continuous webs or discrete sheets unless otherwise stated.

Radiation-curable printing inks, such as UV-curable acrylic resin-based inks, are well known and permit printing to be performed very rapidly due to their greatly reduced drying times over conventional inks.

Conventionally, printing presses using radiation-curable inks have been provided with a high powered radiation source, for example a multi-lamp UV source, at one end of the press to cure the ink on the finished printed web in a single curing step. However, this has meant that after the first printing station within the press, the ink applied onto the web at each subsequent printing station may be superimposed on one or more ink films which are still wet. With increasing press speeds and increasing numbers of printing stations within presses, this has resulted in high energy consumption and poor printing quality.

There is thus a demand from printers, and particularly carton printers, for presses adapted to cure radiation-curable inks between printing stations and thus allow a wet-on-dry printing and an improved depth-of-cure performance to be achieved.

However, printing presses are extremely expensive items and modification of existing presses by the insertion between printing stations of full width radiation sources has raised several problems.

Thus, conventional presses are designed with economy of space in mind and existing components of the presses interfere with full width radiation sources inserted between printing stations to cause noticeable shadowing of the printed web resulting in the ink on significant areas of the printed web remaining incompletely cured and so leading to high web wastage. As a major proportion of the cost of preparing printed cartons is the cost of the basic web material, a prime objective of the printer is always to minimize the wastage due to incomplete or unsatisfactory print coverage.

In conventional sheet-printing apparatus, there are a number of transfer stations in the sheet-handling system at which full width radiation sources could be inserted to produce a relatively low degree of shadowing. However, at these transfer stations, sheet guides are provided, either in the form of mechanical guides or air blowing ducts, and these guides themselves inevitably cause some shadowing and the removal of these guides is not feasible as severe sheet marking and spoilage would result.

It has been found in practice that the degree of shadowing can be reduced to some extent by increasing the power of the radiation source; however, this simply adds to another drawback to this modification of existing presses—the high power output of the radiation sources which is uneconomical and may result in undesirable overheating of components of the press.

Conventional presses do not generally have sufficient space to allow a full width radiation source to be inserted between printing stations at a spacing from the web which will allow the radiation to be completely focussed onto the web. As a result, radiation sources of higher than optimal power tend to be used.

Since only a relatively small proportion of the radiation from conventional radiation sources is of the wavelength or wavelength range required to cure the inks (of the order of 20% in the case of UV curing lamps) the energy output of the radiation sources is greatly in excess of the energy actually required by the inks for curing to take place.

The excess energy output is highly undesirable not only for reasons for economy but also since it raises the likelihood of malfunction by the printing press.

It is therefore an objective of the present invention to provide printing apparatus which allows the curing of radiation-curable inks between printing stations with a reduced wastage of energy and web material.

Viewed from one aspect, the invention provides a web printing apparatus comprising a web feed means,at least two printing stations arranged to print radiation-curable ink onto a web and a primary radiation source arranged to radiate said web with an ink-curing radiation after said web has passed a first said printing station and before said web passes the subsequent printing station, wherein said apparatus further comprises a plurality of secondary radiation sources each extending part way across the width of said web and each being arranged to radiate a part of said width after said web has passed said first printing station and before it has passed said subsequent printing station.

Conveniently the secondary radiation sources are arranged to irradiate parts of the web width selected from parts which receive lower exposure to radiation from said primary radiation source than the average across said width, parts which receive a higher quantity of ink at said first printing station than the average across said width, and parts which receive a quantity of low radiation transmission ink at said first printing station.

By low radiation transmission inks is meant inks which by virtue of their poor transmission of curing radiation, eg UV-curable inks containing pigments which decrease UV transmission, require higher than normal radiation exposure to effect curing.

In the web printing apparatus of the invention, which may be apparatus for printing continuous webs or discrete sheets, the primary radiation source is conveniently operated at a power emission level which is sufficient to cure some but not all of the ink applied to the web at the said first printing station, preferably an emission level sufficient to cure only ink concentrations up to the average applied to the web as a whole: the web areas to which higher than average ink concentrations are applied will then be cured by exposure to the secondary radiation sources. To achieve an optimum, in energy expenditure, one or more of the secondary radiation sources is thus preferably movable transverse to the web feed direction to enable it to be positioned to irradiate such a higher than average ink concentration area on the web.

In a particularly preferred embodiment, the web printing apparatus of the invention is provided with control means arranged to control the position and/or power emission of the secondary radiation sources in response to the levels of ink fed to the web at the said first printing station. Where the total quantity of ink supplied across the width of the web varies significantly along the length of the web, then the control means can advantageously also be used to vary the power emission of the primary radiation source accordingly to optimize energy expenditure.

In the case of presses adapted for printing discrete sheets rather than continuous webs, the problem of shadowing is particularly severe as the web feed mechanism, in order to operate effectively, generally requires sheet gripping or holding means between each printing station. Indeed, such apparatus generally comprises a series of web feed means separated by transfer stations at which the sheet is transferred from one web feed means to another. As mentioned above, at such transfer stations the apparatus is provided with a sheet guides, such as mechanical guides or air blowing ducts, to avoid damage to the sheets on transfer from one web feed means to the next. In such web printing apparatus according to the invention, secondary radiation sources are conveniently located at such transfer stations and, to enable the secondary radiation sources to be placed to irradiate the required parts of the web, the sheet guides and the secondary radiation sources at the transfer station are preferably movable transverse to the sheet feed direction. In operation, each guide means thus preferably has disposed on either side one of the secondary radiation sources. However, we have now also found that sources of ink curing radiation can be positioned at such a transfer station without causing unacceptable shadowing if the sheet guide means are themselves caused to move transversely to the sheets so that they cover or shadow an area of the sheet for only part of the time that that area is exposed to the radiation from the radiation sources.

Viewed from another aspect therefore, the invention provides a sheet printing apparatus ccmprising a plurality of sheet feed means for feeding sheets through said apparatus, adjacent sheet feed means being separated by sheet transfer stations each provided with sheet guide means (which guide the sheets passing between adjacent sheet feed means), at least two printing stations arranged to print radiation curable ink onto sheets fed therethrough, and a radiation source arranged at a first said sheet transfer station to irradiate a said sheet with an ink-curing radiation after said sheet has passed through a first said printing station and before said sheet passes through the subsequent printing station, wherein said sheet guide means at said first sheet transfer station are provided with driving means arranged to drive said sheet guide means in a direction transverse to the sheet feed direction at said first sheet transfer station thereby to reduce or eliminate the shadowing of said sheet from the radiation from said radiation source by said sheet guide means.

In the sheet printing apparatus of the invention, the radiation source at the sheet transfer station preferably comprises a plurality of radiation sources in order that their power emission may be utilised most efficiently. Some or all of these radiation sources (hereinafter called secondary radiation sources for ease of reference) are preferably movable transversely to the sheet feed direction and, in a particularly preferred embodiment, one or more of the secondary radiation sources is provided with driving means to enable it to be driven across the sheet synchronously with the sheet guide means.

The sheet printing apparatus of the invention is preferably provided with a control means to control the position and/or power emission of the secondary radiation sources in order to optimise power usage and printing quality.

Furthermore, the sheet printing apparatus of the invention may conveniently also include, between the said first and subsequent printing stations, a further radiation source (hereinafter referred to as a primary radiation source) arranged to irradiate substantially the full width of the sheets but at a level insufficient to cure fully all the ink deposited on the sheets at the said first printing station. The primary and secondary radiation sources and the control means are preferably operated as described above for the web printing apparatus of the invention in response to the ink feed levels at the first printing station in order to optimise energy expenditure.

In both the web and sheet printing apparatus of the invention, the features of both of which may desirably be combined in a single printing apparatus, it is preferred that a secondary radiation source be set to irradiate each lateral edge of the sheet or continuous web to reduce shadowing and to increase the percentage of the width of the web that can satisfactorily be printed, thereby reducing wastage. The secondary radiation sources in the apparatus of the invention conveniently each extend over only a minor proportion, for example 5–40% and preferably 10–20%, of the width of the web or sheet.

In apparatus according to the invention containing three or more printing stations, the improved arrangement of ink curing means may be disposed between one or more of the adjacent printing stations.

Where existing sheet printing apparatus is to be modified, as will generally be the case, this may most conveniently be achieved by incorporating into the apparatus an ink curing station as a single unit. Thus according to a further aspect of the present invention there is provided ink curing apparatus adapted to be disposed between and to permit transfer of sheets between adjacent sheet feed means in a sheet printing apparatus, said ink curing apparatus comprising sheet guide means provided with first driving means arranged to drive said sheet guide means in a direction transverse to the flow direction of sheets being guided thereby, and a plurality of radiation sources arranged to radiate with ink-curing radiation sheets being guided by said sheet guide means, at least one of said radiation sources being movable in said direction transverse to the sheet flow direction and at least one of the movable radiation sources being provided with second driving means synchronised in operation with said first driving means, thereby to reduce or eliminate shadowing of said sheets from radiation from said radiation sources by said sheet guide means.

The apparatus of the invention is particularly suitable for use with UV-curable inks, in which case UV-sources are used as the primary and secondary radiation sources. In such apparatus, expenditure on UV light generation may be reduced by as much as 90% over the use of full width UV sources alone, for example 1.5 kW as opposed to 17 kW, resulting in a reduction in the operating temperatures of certain press components, for example a reduction from 80° C. to 40° C.

Thus according to the invention, not only can a significant reduction in running costs be achieved but also printing quality may be increased and web wastage and press damage may be reduced.

Viewed from a yet further aspect, the present invention provides a method of printing in which radiation curable ink is applied to a web at at least two printing stations during the passage of said web through a printing press, wherein between two adjacent printing station the ink applied to said web is cured in two steps, the steps comprising (a) the exposure of substantially the entire width of said web to ink-curing radiation from a primary radiation source at an exposure level insufficient to cure all of the ink applied to said web at the first of said two adjacent printing stations, and (b) the exposure of said web to ink-curing radiation from a plurality of secondary radiation sources each arranged to irradiate a predetermined part of the width of the web, thereby to cure parts of the web selected from parts shadowed from the radiation from said primary radiation source and parts bearing higher ink densities than are curable by exposure to said primary radiation source alone.

A preferred embodiment of the method and apparatus of the invention will now be described by the way of example and with reference to the accompanying drawings in which:

FIG. 1 illustrates a schematic perspective view of part of a sheet printing apparatus according to the present invention.

Referring to FIG. 1, there is shown part of a sheet printing apparatus 20 having at least two printing stations 21 and 22 at sheet transfer stations 1 and 2 respectively. Sheet material 3 is carried to printing station 21 by sheet feed means 4, from printing station 21 to printing station 22 by sheet feed means 5, and from printing station 22 by sheet feed means 6. Each printing station comprises a carrier cylinder 7 and a print roll 8, each rotated in the directions shown by arrows. UV-curable ink is fed to print rolls 8 by conventional means not shown in the FIGURE.

A sheet fed on to carrier rolls 7 is held in position by sheet guides 9 and, leaving carrier rolls 7, is gripped by a transversely extending gripper bar 10 of the sheet feed means and carried to the carrier roll of the next printing station.

In the apparatus shown, the sheets leaving printing station 21 are exposed to UV radiation from lamps 11 which extend across substantially the full width of the sheets. To improve irradiation efficiency, lamps 11 are provided with reflectors 12. The radiation emission of lamps 11 is generally set to be sufficient to cure the average ink density applied by the previous print roll 8 but may be controlled in response to the ink deposition rate at the previous printing station by control unit 16. The sheets are subsequently exposed to radiation from a second set of UV lamps 13, 14, also provided with reflectors 12 and also controlled by control unit 16. Lamps 13, 14 are shorter than the full width lamps 11 and are directed at carrier roll 7 so as to irradiate preselected portions of the sheet thereon. As shown, lamps 13 are directed at the lateral edges of the sheet and sheet guides 9 together with lamp 14 are caused to oscillate parallel to the cylinder axis of the carrier roll by drive means 15 and 17 controlled by control means 16. This oscillatory motion prevents shadowing of the sheet by sheet guides 9.

For a carton printing press operated at a sheet feed rate of 4 m/sec and with a sheet width of 1.4 m, a total of two 17 kW full width (1.4 m) and three short (0.1 m) 1.5 kW UV lamps between two adjacent printing stations has been found to produce good results in terms of printing quality. The total energy consumption of 38.5 kW compares with the 51 kW used in an equivalent conventional machine using only three full width 17 kW UV lamps.

I claim:

1. A web printing apparatus comprising a web feed means, at least two printing stations arranged to print radiation-curable ink onto a web and primary radiation source arranged to radiate said web with an ink-curing radiation after said web has passed a first said printing station and before said web passes the subsequent printing station, wherein said apparatus further comprises a plurality of secondary radiation sources each extending part way across the width of said web and each being arranged to radiate a part of said width after said web has passed said first printing station and before it has passed said subsequent printing station, and wherein at least one of said secondary radiation sources is provided with source driving means capable of moving it transverse to the web feed direction of the said apparatus.

2. Apparatus as claimed in claim 1 in the form of sheet printing apparatus wherein said feed means are sheet feed means wherein said apparatus is provided between adjacent sheet feed means with sheet transfer stations provided with sheet guide means, said secondary radiation sources being positioned at at least one said sheet transfer station whereat guide driving means are arranged to drive said guide means in a direction transverse to the sheet feed direction whereby to reduce or eliminate the shadowing of sheets by said guide means from the radiation from said secondary radiation source.

3. Apparatus as claimed in claim 1 wherein said source driving means is provided with control means adapted to position the movable secondary radiation source to irradiate a part of said width selected from parts which receive lower exposure to radiation from said primary radiation source than the average across said width, parts which receive a higher quantity of ink at said first printing station than the average across said width, and parts which receive a quantity of low radiation transmission ink at said first printing station.

4. Apparatus as claimed in claim 2 wherein said source driving means is provided with control means adapted to position the movable secondary radiation source to irradiate a part of said width selected from parts which receive lower exposure to radiation from said primary radiation source than the average across said width, parts which receive a higher quantity of ink at said first printing station than the average across said width, and parts which receive a quantity of low radiation transmission ink at said first printing station.

5. Apparatus as claimed in claim 3 wherein said control means is further arranged to control the radiation emission of said radiation sources in response to the ink deposition rate at said first printing station.

6. Apparatus as claimed in claim 4 wherein said control means is further arranged to control the radiation emission of said radiation sources in response to the ink deposition rate at said first printing station.

7. Apparatus as claimed in claim 1 wherein said secondary radiation sources each extend over from 10 to 20% of said width.

8. A sheet printing apparatus comprising a plurality of sheet feed means for feeding sheets through said apparatus, adjacent sheet feed means being separated by sheet transfer stations each provided with sheet guide means, at least two printing stations arranged to print radiation-curable ink onto sheets fed therethrough, and a radiation source arranged at a first said sheet transfer station to irradiate a said sheet with an ink-curing radiation after said sheet has passed through a first said printing station and before said sheet passes through the subsequent printing station, wherein said sheet guide means at said first sheet transfer station are provided with driving means arranged to drive said sheet guide means in a direction transverse to the sheet feed direction at said first sheet transfer station thereby to reduce or eliminate the shadowing of said sheet from the radiation from said radiation source by said sheet guide means.

9. Apparatus as claimed in claim 8 wherein said radiation source comprises a plurality of radiation sources at least one of which is provided with source driving means capable of moving it in a direction transverse to the sheet feed direction of the apparatus, wherein said apparatus is provided with a further radiation source arranged to irradiate a said sheet with an ink curing radiation after said sheet has passed through said first printing station and before said sheet is exposed to radiation from said plurality of radiation sources, and wherein said source driving means is provided with a control means adapted to position the movable radiation sources of said plurality of radiation sources to irradiate a part of said width selected from parts which receive lower exposure to radiation from said further radiation source than the average across said width, parts which receive a higher quantity of ink at said first printing station than the average across said width, and parts which receive a quantity of low radiation transmission ink at said first printing station.

10. Apparatus as claimed in claim 9 wherein said control means is further arranged to control the radiation emission of said radiation sources in response to the ink deposition rate at said first printing station.

11. An ink curing apparatus adapted to be disposed between and to permit transfer of sheets between adjacent sheet feed means in a sheet printing apparatus, said ink curing apparatus comprising sheet guide means provided with first driving means arranged to drive said sheet guide means in a direction transverse to the flow direction of sheets being guided thereby, and a plurality of radiation sources arranged to irradiate with ink-curing radiation sheets being guided by said sheet guide means, at least one of said radiation sources being movable in said direction transverse to the sheet flow direction and at least one of the movable radiation sources being provided with second driving means synchronised in operation with said first driving means, thereby to reduce or eliminate shadowing of said sheets from radiation from said radiation sources by said sheet guide means.

12. A method of printing in which radiation curable ink is applied to a web at at least two printing stations during the passage of said web through a printing press, wherein between two adjacent printing stations the ink applied to said web is cured in two steps, the steps comprising (a) the exposure of substantially the entire width of said web to ink-curing radiation from a primary radiation source at an exposure level insufficient to cure all of the ink applied to said web at the first of said two adjacent printing stations, and (b) the exposure of said web to ink-curing radiation from a plurality of secondary radiation sources each of which is arranged to irradiate a predetermined part of the width of the web and at least one of which is provided with source driving means capable of moving it transverse to the web feed direction through the printing press, thereby to cure parts of the web selected from parts shadowed from the radiation from said primary radiation source and parts bearing higher ink densities than are curable by exposure to said primary radiation source alone.

13. A web printing apparatus comprising a web feed means, at least two printing stations arranged to print radiation-curable ink onto a web and a primary radiation source arranged to radiate said web with an ink-curing radiation after said web has passed a first said printing station and before said web passes the subsequent printing station, wherein said apparatus further comprises a plurality of secondary radiation sources each extending part way across the width of said web and each being arranged to radiate a part of said width after said web has passed said first printing station and before it has passed said subsequent printing station, and wherein said secondary radiation sources each extend over from 10 to 20% of said width.

14. A method of printing in which radiation curable ink is applied to a web at at least two printing stations during the passage of said web through a printing press, wherein between two adjacent printing stations the ink applied to said web is cured in two steps, the steps comprising (a) the exposure of substantially the entire width of said web to ink-curing radiation from a primary radiation source at an exposure level insufficient to cure all of the ink applied to said web at the first of said two adjacent printing stations, and (b) the exposure of said web to ink-curing radiation from a plurality of secondary radiation sources each extending over from 10 to 20% of the width of the web and each arranged to irradiate a predetermined part of the web, thereby to cure parts of the web selected from parts shadowed from the radiation from said primary radiation source and parts bearing higher ink densities than are curable by exposure to said primary radiation source alone.

* * * * *